US007409895B1

(12) United States Patent
Herrick

(10) Patent No.: US 7,409,895 B1
(45) Date of Patent: Aug. 12, 2008

(54) ECCENTRIC ROTARY PLIERS

(76) Inventor: Richard P. Herrick, 4290 SW. 141st. Ave., Miramar, FL (US) 33027

( * ) Notice: Subject to any disclaimer, the term of this patent is extended or adjusted under 35 U.S.C. 154(b) by 0 days.

(21) Appl. No.: 11/786,096

(22) Filed: Apr. 10, 2007

(51) Int. Cl.
*B24B 7/04* (2006.01)

(52) U.S. Cl. ..... 81/385; 81/386; 81/387

(58) Field of Classification Search ..... 81/385, 81/386, 387
See application file for complete search history.

(56) References Cited

U.S. PATENT DOCUMENTS 4,156,368 A * 5/1979 Jackson ..... 74/89.45
4,687,400 A * 8/1987 Lichti ..... 414/4
6,883,400 B2 * 4/2005 Sugano ..... 81/53.11

* cited by examiner

*Primary Examiner*—Joseph J. Hail, III
*Assistant Examiner*—Shantese L McDonald
(74) *Attorney, Agent, or Firm*—Oltman, Flynn & Kubler

(57) ABSTRACT

Rotary pliers include a guide tube having a guide tube wall and a guide tube longitudinal axis and a guide tube proximal end connected to a radially protruding tube rotation lever and having a tube distal end with a distally protruding plier outer jaw radially spaced from the guide tube longitudinal axis; and a torque transmission shaft rotatably retained within the guide tube having a shaft proximal end connected to a radially protruding shaft rotation lever adjacent to the tube rotation lever and having a shaft distal end with a distally protruding plier inner jaw circumferentially aligned with the plier outer jaw; so that rotation of the torque transmission shaft relative to the guide tube by pivoting the tube rotation lever and shaft rotation lever relative to each other rotates the plier inner jaw along a circumferential path which is one of: toward or away from abutment with the plier outer jaw to grip or release an object.

7 Claims, 3 Drawing Sheets

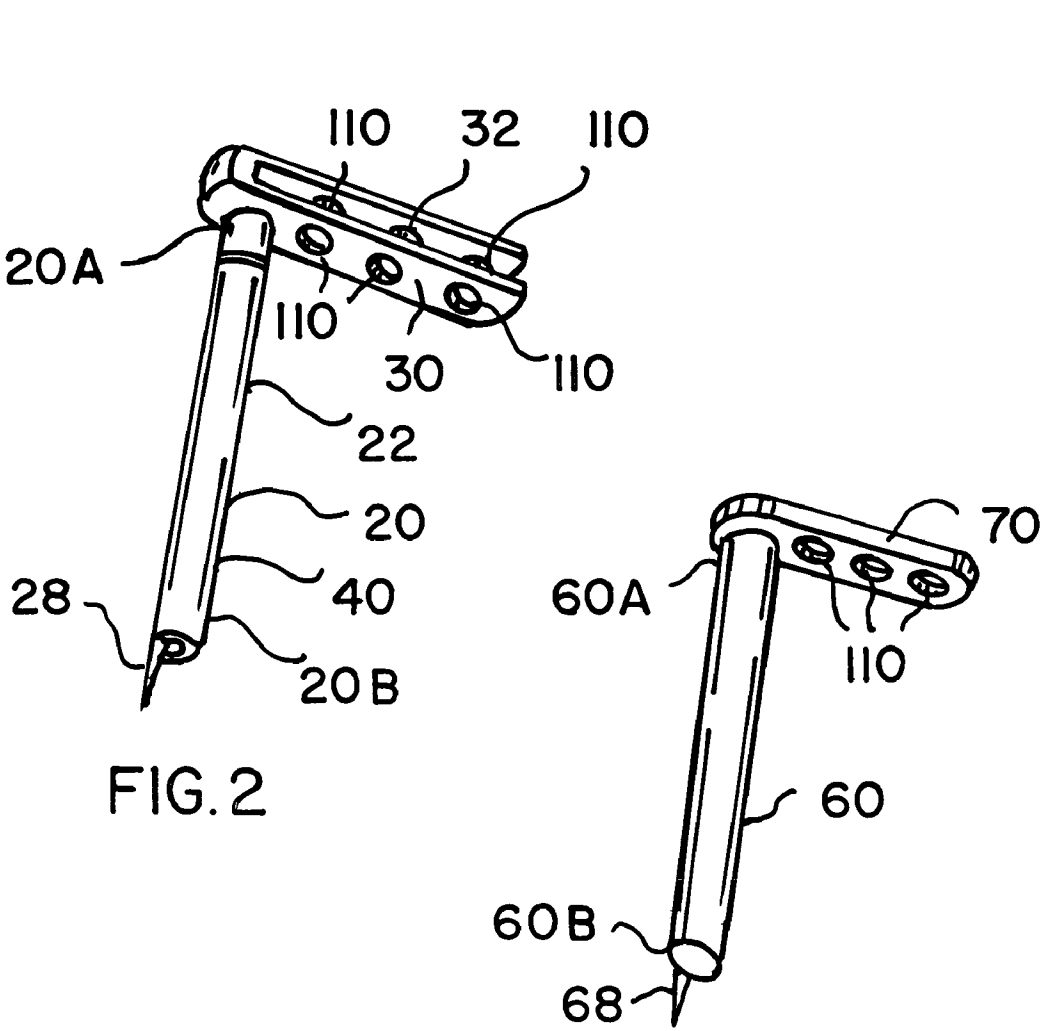
FIG. 3
FIG. 2
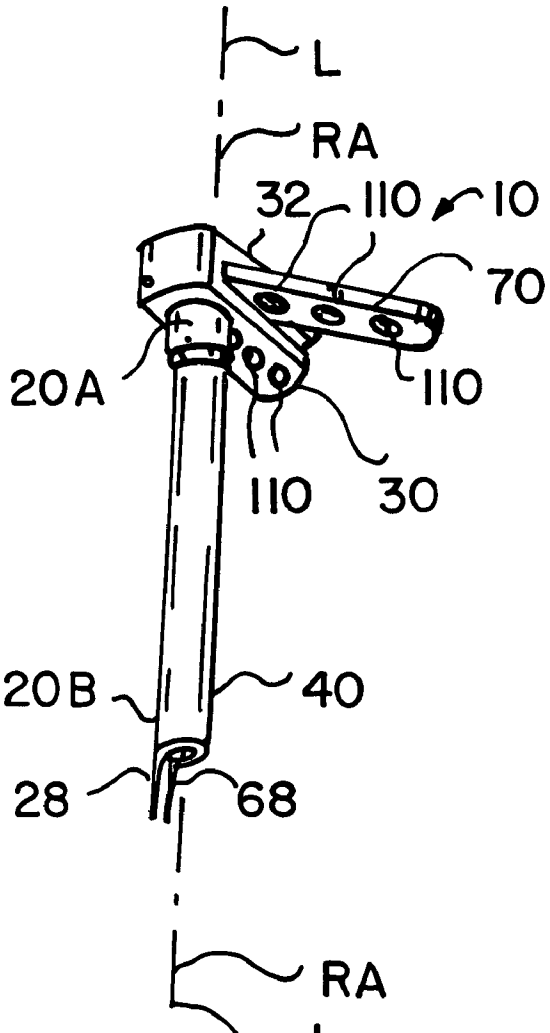
FIG. 1

ECCENTRIC ROTARY PLIERS

FILING HISTORY

This application continues from provisional application Ser. No. 60/756,891 filed on Jan. 6, 2006.

BACKGROUND OF THE INVENTION

1. Field of the Invention

The present invention relates generally to the field of hand tools. More specifically the present invention relates to eccentric rotary pliers for gripping an object with tremendous mechanical advantage and having a long reach into a tight space with virtually undiminished gripping force. The pliers include a shaft guide structure preferably in the form of a guide tube having a tube proximal end connected to a radially protruding tube rotation lever and having a tube distal end with a distally protruding plier outer jaw radially spaced from the guide tube longitudinal axis, and includes a torque transmission shaft rotatably retained within the guide tube having a shaft proximal end connected to a radially protruding shaft rotation lever adjacent to the tube rotation lever and having a shaft distal end with a plier inner jaw circumferentially aligned with the plier outer jaw, such that rotation of the torque transmission shaft relative to the guide tube by pivoting the tube rotation lever and shaft rotation lever relative to each other rotates the plier inner jaw along a circumferential path either toward or away from abutment with the plier outer jaw to grip or release an object between plier inner and outer jaws. The large ratio of the radial distance from the shaft rotational axis to the jaws and to the gripped region of the lever gives the pliers a very great mechanical advantage, on the order of 80 to 1, or 80 pounds gripping force between the inner and outer jaws for each pound of gripping force applied to the lever.

2. Description of the Prior Art

Conventional pliers include two elongate members pivoting in their middle regions about an interconnecting bolt which define plier jaws at member distal ends and plier handles at member proximal ends. A problem with these prior pliers is that they typically give a mechanical advantage of no more than five to one, and more typically of one two or three to one. Another problem has been that conventional pliers have a limited reach along a narrow path which cannot be extended in a practical way, limiting their usefulness when working on a vehicle engine and in many other applications.

It is thus an object of the present invention to provide eccentric rotary pliers which can provide a mechanical advantage of dozens of pounds of pliers gripping force to each pound of user hand gripping force.

It is another object of the present invention to provide such eccentric rotary pliers which can be designed to reach up to several feet along a narrow path with negligible loss in mechanical advantage, and may be used to feed wire into a distant opening.

It is still another object of the present invention to provide such eccentric rotary pliers which are compact and can be carried in most tool boxes, in a belt or in a holster.

It is finally an object of the present invention to provide such eccentric rotary pliers which are durable, reliable and relatively inexpensive to manufacture.

SUMMARY OF THE INVENTION

The present invention accomplishes the above-stated objectives, as well as others, as may be determined by a fair reading and interpretation of the entire specification.

Rotary pliers are provided including a guide tube having a guide tube wall and a guide tube longitudinal axis and a guide tube proximal end connected to a radially protruding tube rotation lever and having a tube distal end with a distally protruding plier outer jaw radially spaced from the guide tube longitudinal axis; and a torque transmission shaft rotatably retained within the guide tube having a shaft proximal end connected to a radially protruding shaft rotation lever adjacent to the tube rotation lever and having a shaft distal end with a distally protruding plier inner jaw circumferentially aligned with the plier outer jaw; so that rotation of the torque transmission shaft relative to the guide tube by pivoting the tube rotation lever and shaft rotation lever relative to each other rotates the plier inner jaw along a circumferential path which is one of: toward abutment with the plier outer jaw to grip an object between the plier inner jaw and the plier outer jaw, and away from abutment with the plier outer jaw to release an object between the plier inner jaw and the plier outer jaw.

The rotary pliers preferably additionally includes a light source secured to the shaft distal end and a power source electrically connected to the light source. The light source preferably is a light emitting diode. The tube rotation lever preferably includes a channel member and the shaft rotation lever comprises an elongate shaft rotation lever plate having a thickness sufficiently narrow to fit within the channel member, so that when the levers are pivoted rotationally together the shaft rotation lever pivots into the channel member. The shaft rotation lever plate preferably has a shaft port through which the shaft proximal end passes and is secured with a set screw passing through a set screw port in the shaft rotation lever plate. The at least one of the plier inner jaw and the plier outer jaw has a rough gripping surface.

Rotary pliers are further provided including: a guide structure having a guide structure wall and a guide structure longitudinal axis and a guide structure proximal end connected to a radially protruding guide structure rotation lever and having a guide structure distal end with a distally protruding plier outer jaw radially spaced from the guide structure longitudinal axis; and a torque transmission shaft rotatably retained within the guide tube having a shaft proximal end connected to a radially protruding shaft rotation lever adjacent to the guide structure rotation lever and having a shaft distal end with a distally protruding plier inner jaw circumferentially aligned with the plier outer jaw; so that rotation of the torque transmission shaft relative to the guide structure by pivoting the guide structure rotation lever and shaft rotation lever relative to each other rotates the plier inner jaw along a circumferential path which is one of: toward abutment with the plier outer jaw to grip an object between the plier inner jaw and the plier outer jaw, and away from abutment with the plier outer jaw to release an object between the plier inner jaw and the plier outer jaw.

BRIEF DESCRIPTION OF THE DRAWINGS

Various other objects, advantages, and features of the invention will become apparent to those skilled in the art from the following discussion taken in conjunction with the following drawings, in which:

FIG. 1 is a side perspective view of the pliers preferred embodiment.

FIG. 2 is a side perspective view of the guide tube and tube rotation lever without the torque transmission shaft and shaft rotation lever.

FIG. 3 is a side perspective view of the torque transmission shaft and shaft rotation lever separated from the rest of the pliers.

DETAILED DESCRIPTION OF THE PREFERRED EMBODIMENTS

Figure 4:
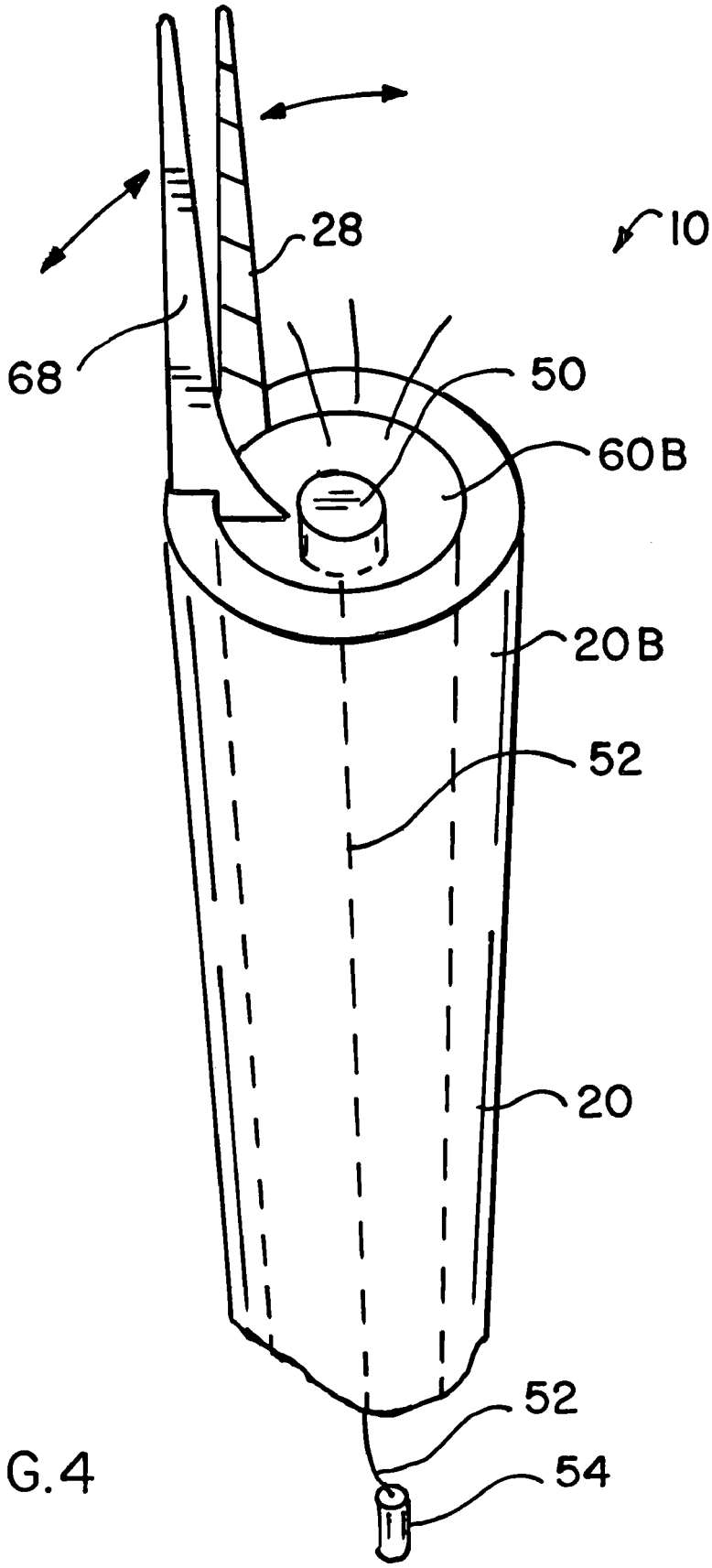
FIG. 4 is a distal end view of the pliers of FIG. 1 providing a close-up view of the inner and outer jaws and also showing the optional light emitting diode mounted in the shaft distal end and a light circuit wire extending axially through torque transmission shaft to a battery power source.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 5:
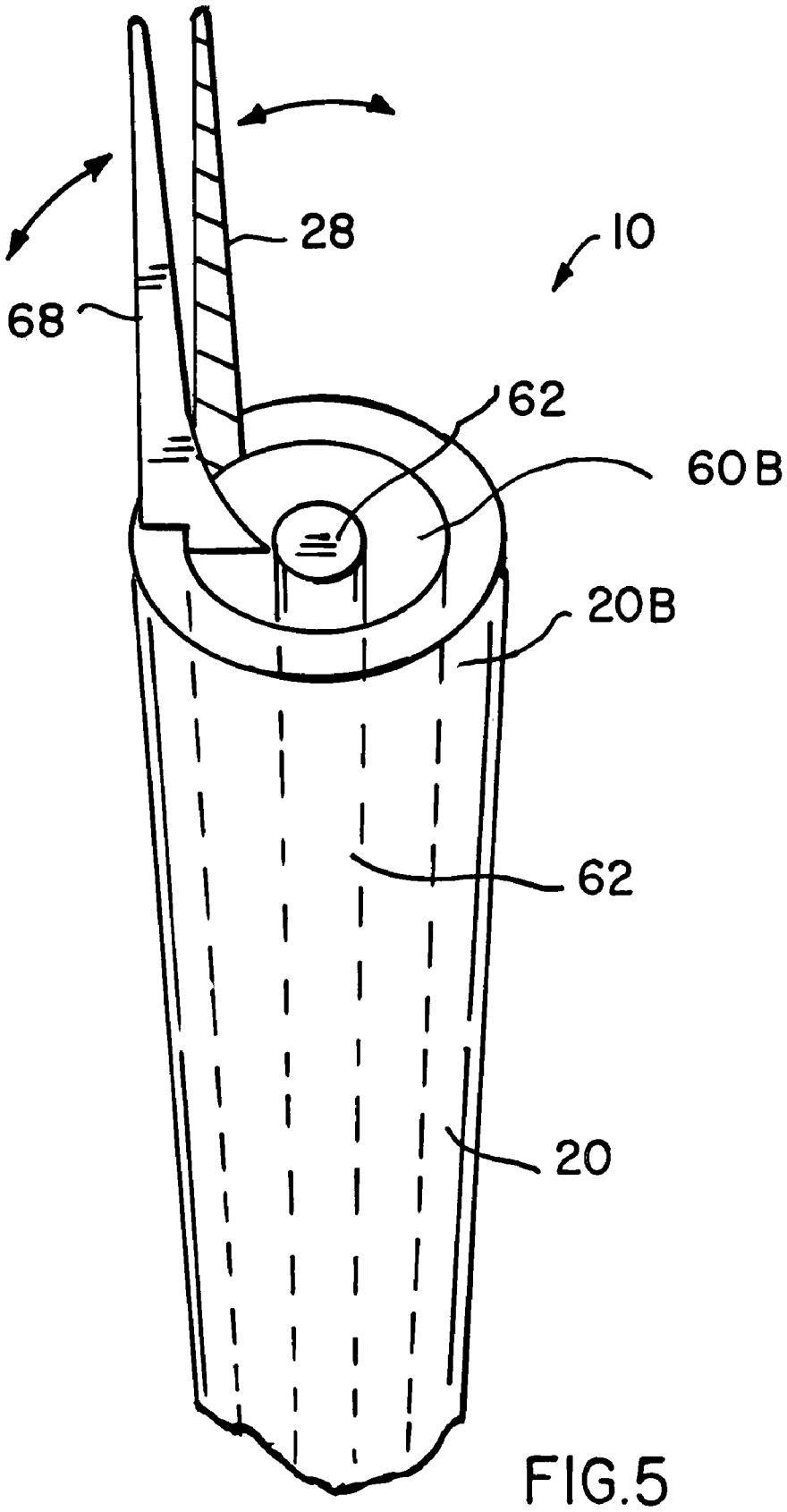
FIG. 5 is a view as in FIG. 4 except that the light emitting diode and circuit are replaced with an optional wire passageway extending axially through the torque transmission shaft.

Referring to FIGS. 1-5, eccentric rotary pliers 10 is disclosed for gripping an object with tremendous mechanical advantage and having a long reach in narrow confines. The pliers 10 include a shaft guide structure preferably in the form of a guide tube 20 having a guide structure proximal end in the form of a guide tube proximal end 20A connected to a radially protruding guide structure rotation lever in the form of a tube rotation lever 30 and having a guide structure distal end in the form of a guide tube distal end 20B with a distally protruding plier outer jaw 28 radially spaced from the guide tube longitudinal axis L, and includes a torque transmission shaft 60 rotatably retained within the guide tube 20 having a shaft proximal end 60A connected to a radially protruding shaft rotation lever 70 adjacent to the tube rotation lever 30 and having a shaft distal end 60B a plier inner jaw 68 circumferentially aligned with the plier outer jaw 28, such that rotation of the torque transmission shaft 60 relative to the guide tube 20 by pivoting the tube rotation lever 30 and shaft rotation lever 70 relative to each other rotates the plier inner jaw 28 along a circumferential path toward or away from abutment with the plier outer jaw 28 to grip or release an object positioned between the inner and outer jaws 68 and 28. Inner and outer jaws 68 and 28 preferably have rough textured jaw abutment surfaces. The large ratio between the radial distance from the shaft rotational axis RA and the radial distance between the shaft rotational axis RA and the gripped region of the shaft rotation lever 70 gives the pliers 10 a very great mechanical advantage, on the order of 80 pounds gripping force between the inner and outer jaws 68 and 28 for each pound of gripping force applied to either lever 70 and 30 relative to the other gripping lever 30 or 70.

The jaw gripping force is so great that it can cause the torque transmission shaft 60 to become axially skewed within the guide tube 20 so that friction between the torque transmission shaft 60 and the guide tube 20 prevents the shaft 60 and the guide tube 20 from rotating axially relative to each other and thus effectively locks the plier inner and outer jaws 68 and 28 into gripping contact with an object between them. This skewed friction engagement results from the force of the plier outer jaw 28 bearing against the plier inner jaw 68 which in turn slightly tilts the shaft distal end 60B into firm abutment with the guide tube 20.

A light emitting diode (LED) 50 preferably is mounted to the center of the shaft distal end 60B and a circuit wire 52 extends proximally through an axial passageway in the torque transmission shaft to a battery power source 54 mounted to the torque transmission shaft proximal end 60A. See FIG. 4. The battery power source 54 appears structurally separated from the torque transmission shaft 60 because the shaft proximal end 60A is omitted in the broken away view in this Figure. Alternatively, the torque transmission shaft 60 optionally contains a wire passageway 62 extending along the shaft rotational axis RA through which a wire can be passed during pliers 10 use. See FIG. 5.

The tube rotation lever 30 preferable takes the form of a channel member 32 and the shaft rotation lever 70 preferably is an elongate metal plate having a thickness sufficiently narrow to fit within the channel member 32 so that when the levers 30 and 70 are pivoted together the shaft rotation lever 70 pivots into the channel of the tube rotation lever 30. The tube rotation lever 30 preferably is fastened to the guide tube proximal end 20A with a set screw (not shown). Several circular lever openings 110 preferably are provided in both levers 30 and 70 to conserve materials and for ornamental enhancement. The pliers 10 preferred embodiment can be carried in a holster (not shown) which may be hooked to a belt.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. Rotary pliers, comprising:

a guide tube having a guide tube wall and a guide tube longitudinal axis, said guide tube additionally having a guide tube proximal end connected to a radially protruding tube rotation levers and having a tube distal end with a distally protruding plier outer jaw radially spaced from the guide tube longitudinal axis;

and a torque transmission shaft rotatably retained within said guide tube, said torque transmission shaft having a shaft proximal end connected to a radially protruding shaft rotation lever adjacent to said tube rotation levers and having a shaft distal end with a distally protruding plier inner jaw circumferentially aligned with said plier outer jaw;

such that rotation of said torque transmission shaft relative to said guide tube, by pivoting said tube rotation lever and shaft rotation lever relative to each other, rotates said plier inner jaw along a circumferential path which is one of: toward abutment with said plier outer jaw to grip an object between said plier inner jaw and said plier outer jaw, and away from abutment with said plier outer jaw to release an object between said plier inner jaw and said plier outer jaw.

2. The rotary pliers of claim 1, additionally comprising:

a light source secured to said shaft distal end;

and a power source electrically connected to said light source.

3. The rotary pliers of claim 2, wherein said light source is a light emitting diode.

4. The rotary pliers of claim 1, wherein said tube rotation lever comprises:

a channel member;

and wherein said shaft rotation lever comprises an elongate shaft rotation lever plate having a thickness sufficiently narrow to fit within said channel member;

such that when said levers are pivoted rotationally together said shaft rotation lever pivots into said channel member.

5. The rotary pliers of claim 4, wherein said torque transmission shaft contains a longitudinal wire passageway.

6. The rotary pliers of claim 1, wherein at least one of said plier inner jaw and said plier outer jaw has a rough gripping surface.

7. Rotary pliers, comprising:

a guide structure having a guide structure wall and a guide structure longitudinal axis, said guide tube additionally having a guide structure proximal end connected to a radially protruding guide structure rotation lever, and having a guide structure distal end with a distally protruding plier outer jaw radially spaced from the guide structure longitudinal axis;

and a torque transmission shaft rotatably retained within said guide tube, said torque transmission shaft having a shaft proximal end connected to a radially protruding shaft rotation lever adjacent to said guide structure rotation lever, and having a shaft distal end with a distally protruding plier inner jaw circumferentially aligned with said plier outer jaw;

such that rotation of said torque transmission shaft relative to said guide structure, by pivoting said guide structure rotation lever and shaft rotation lever relative to each other, rotates said plier inner jaw along a circumferential path which is one of: toward abutment with said plier outer jaw to grip an object between said plier inner jaw and said plier outer jaw, and away from abutment with said plier outer jaw to release an object between said plier inner jaw and said plier outer jaw.

* * * * *